US009136052B2

(12) United States Patent
Robertson

(10) Patent No.: US 9,136,052 B2
(45) Date of Patent: Sep. 15, 2015

(54) DIVERGENT FLUX PATH MAGNETIC ACTUATOR AND DEVICES INCORPORATING THE SAME

(76) Inventor: Glen A Robertson, Madison, AL (US)

( * ) Notice: Subject to any disclaimer, the term of this patent is extended or adjusted under 35 U.S.C. 154(b) by 0 days.

(21) Appl. No.: 13/489,638

(22) Filed: Jun. 6, 2012

(65) Prior Publication Data

US 2013/0328649 A1 Dec. 12, 2013

(51) Int. Cl.
*H01F 7/08* (2006.01)
*H01F 7/16* (2006.01)

(52) U.S. Cl.
CPC ..... *H01F 7/08* (2013.01); *H01F 7/1615* (2013.01); *H01F 2007/163* (2013.01); *H01F 2007/1669* (2013.01); *H01F 2007/1692* (2013.01)

(58) Field of Classification Search
CPC ..... H01F 7/1615; H01F 2007/163; H01F 2007/1669; H01F 2007/1692
USPC ..... 335/229–234; 123/90.11
See application file for complete search history.

(56) References Cited

U.S. PATENT DOCUMENTS 3,022,450 A * 2/1962 Chase, Jr. ..... 361/194
3,381,181 A * 4/1968 Weathers ..... 361/210
5,365,210 A * 11/1994 Hines ..... 335/238
6,265,956 B1 * 7/2001 Cascolan et al. ..... 335/234

* cited by examiner

*Primary Examiner* — Ramon Barrera

(57) ABSTRACT

Divergent flux path magnetic actuation is a technique employed to move and magnetically hold an armature in electromechanical actuator devices. These actuators are typically used for linear and reciprocating application with a shaft firmly fixed to the armature to convey movement and forces. By incorporating a bearing in the armature about the shaft, rotation can also be conveyed. Further these actuators are more adaptable to energy saving applications than conventional solenoids, specifically when the control coils are parallel connected to reduce the input voltage from a power source and electrically pulsed activated from a capacitor to reduce the power drain from the power source. Thus a divergent flux path magnetic actuators with reciprocating and rotatable shaft can be used for multipurpose applications and be adapted to a variety of devices for energy savings over convention solenoids.

5 Claims, 7 Drawing Sheets

DIVERGENT FLUX PATH MAGNETIC ACTUATOR AND DEVICES INCORPORATING THE SAME

RELATED APPLICATIONS

Applications related to the foregoing applications include U.S. Patent application entitled "PERMANENT MAGNET LATCHING SOLENOID," having U.S. Pat. No. 6,265,956 B1, date Jul. 24, 2001; J.P. Patent Application entitled "SOLENOID ACTUATOR," having pat. app. No. 7,037,461, date 1995; U.S. Patent entitled "LATCHING SOLENOID WITH MANUAL OVERRIDE," having U.S. Pat. No. 5,365,210, date Nov. 15, 1994; U.S. Patent entitled "ELECTROMAGNETIC DEVICE," having U.S. Pat. No. 3,381,181, date Apr. 30, 1968; U.S. Patent entitled "VARIABLE LIFT OPERATION OF BISTABLE ELECTROMECHANICAL POPPET VALVE ACTUATOR," having U.S. Pat. No. 4,829,947, date May 16, 1989, U.S. Patent application entitled "SOLENOID OPERATED VALVE WITH MAGNETIC LATCH," having U.S. Pat. No. 3,814,376, date Jun. 4, 1974; U.S. Patent entitled "DUAL POSITION LATCHING SOLENOID," having U.S. Pat. No. 3,022,450, date Feb. 20, 1962, the disclosures are hereby incorporated by reference.

FIELD OF THE INVENTION

The present invention relates generally to modifications of divergent flux path magnetic actuators, examples include U.S. Pat. Nos. 3,022,450; 3,381,181; 5,365,210; 6,265,956 B1; J.P. Patent Application 7,037,461, with a bearing to allow the shaft to rotate while reciprocating, wherein the magnetic flux from a toroid or ring shaped radially poled permanent magnet with extended and bi-directional coaxial poles is directionally induced to divert its paths by control coils placed about the movable center pole or armature in order to magnetically attract the armature to pole end closures of a magnetic body or housing that typically comprises the outer housing for the purpose of producing mechanical linear or reciprocating force on the armature, containing a fixed bearing and shaft with the shaft free to rotate in the bearing to translate linear and rotational forces to attached devices.

BACKGROUND OF THE INVENTION

Divergent flux path magnetic actuation is a technique employed to move and magnetically hold an armature in electromechanical devices. Permanent magnets are employed in a manner that places their magnetic field in a bi-stable state to allow control coils to divert the magnetic field in one of two directions within the surrounding magnetic material. Examples of bi-stable permanent magnet actuators include U.S. Pat. Nos. 3,022,450; 3,381,181; 5,365,210; 6,265,956 B1; J.P. Patent Application 7,037,461, each having a magnetic housing with pole end closures incasing a permanent magnet and two controls coils about a moveable central pole piece or armature with the control coils placed one on either side of the permanent magnet. The control coils form a single current directional path to produce a single directional path magnetic field to divert the permanent magnet's magnetic field in one of two directions from the permanent magnet to bi-directionally attract the armature to the pole end closures of the magnetic housing as done in U.S. Pat. Nos. 3,022,450; 3,381,181; 5,365,210; 6,265,956 B1; J.P. Patent Application 7,037,461.

The aforementioned prior art divergent flux path magnetic actuation techniques employ switches to control the current direction from a power source. For large actuators, the power source can become quite large due to the required energy drain per time to the control coils. An energy savings method to greatly reduce the required energy drain per time from a power source can be achieved by using low power input from a power source to charge a capacitor and discharge the current from the capacitor into the control coils using a H-bridge to control the current direction and pulse time.

Further, a divergent flux path magnetic actuator can be enhanced for greater linear motion distance, output force or increased electrical efficiency through the adaptation of other force mechanisms that do not require electrical power for further energy savings. For example, springs can be employed as an additional force mechanism, where the springs store and release energy as needed by the actuator.

SUMMARY OF THE INVENTION

Divergent flux path magnetic actuators are:

Typically used for linear and reciprocating application with a shaft firmly fixed to the armature to convey linear or reciprocating motion. By incorporating a fixed bearing in the armature about the shaft, rotation can also be conveyed. It is then an object of the present invention to produce a divergent flux path magnetic actuator that can convey rotational motion as well as linear or reciprocating motion.

More adaptable to energy saving applications than conventional solenoids, specifically when their control coils are parallel connected to reduce the input voltage from a power source and electrically pulsed from a capacitor to reduce the energy drain from the power source. It is then an object of the present invention to show an energy saving method for divergent flux path magnetic actuators.

A divergent flux path magnetic actuator with reciprocating and rotating shaft lends itself to applications where the shaft needs to be disengaged on one side of the bearing. It is then an object of the present invention to show the incorporation of a mating spline, where the linear motion of the bearing-armature assembly disengages a portion of the shaft from the bearing.

BRIEF DESCRIPTION OF THE DRAWINGS

For a better understanding of the present invention, reference is made to the accompanying drawings in which:

FIG. 8 illustrates the current trace for a conventional solenoid actuator. FIGS. 9-10 are pulse current traces from two different versions of a divergent flux path magnetic actuator using the same capacitor/voltage setup and the method of FIGS. 4-7, where FIG. 9 shows an ideal pulse current trace for minimum energy use and FIG. 10 shows that the capacitor/voltage setup was over designed for the versions of the divergent flux path magnetic actuator used.

DETAILED DESCRIPTION OF THE INVENTION

Figure 1:
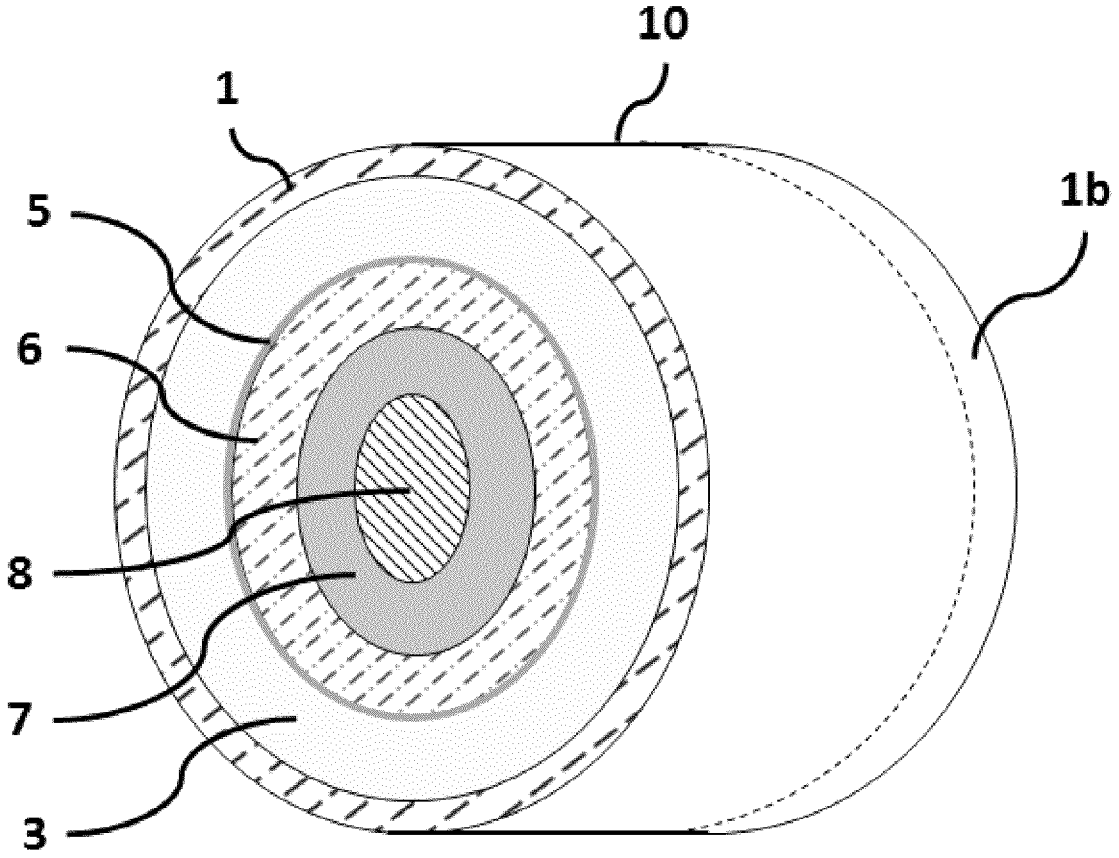
FIG. 1 is a perspective view of one embodiment of a divergent flux path magnetic actuator with a bearing and rotating shaft and with one end closure removed for clarity.
Figure 2:
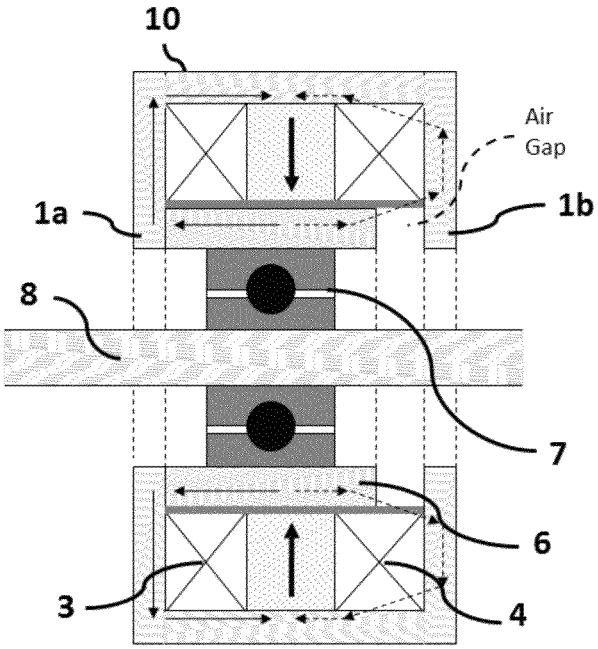
FIGS. 2-3 are cross-sectional views of a divergent flux path magnetic actuator with a bearing and rotating shaft, showing the different latching positions, and showing the bi-directional magnetic flux paths.
Figure 3:
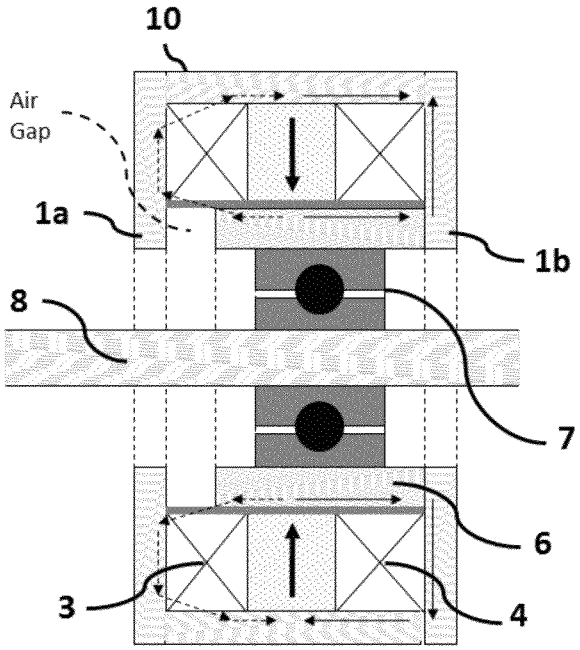

Referring now to the drawings, FIGS. 1-3 are provided to facilitate an understanding of the various aspects or features of a divergent flux path magnetic actuator with a reciprocating and rotatable shaft containing a bearing 7 to allow rotation of shaft 8.

FIGS. 1-3 depict the cylindrical form of a divergent flux path magnetic actuator 10 as used throughout this specification. FIG. 1 has attractive end closure 1*a* removed for clarity. FIGS. 2-3 show the two positions of the armature 6, bearing 7, and shaft 8. In FIGS. 1-3 and as used throughout this specification, the permanent magnet 2 has a flat toroid shape and is poled radially (dark arrow) with north inward of the toroid, where dark, light, and dashed arrows are used to portray the magnetic field direction in the actuator 10.

In FIGS. 1-3, the divergent flux path magnetic actuator 10 has a magnetic enclosure or housing 1 with firmly attached end closures 1*a* and 1*b* perpendicular to the length, and contains:

(a) A firmly fixed toroid or ring shaped radially poled permanent magnet 2 having concentric magnet pole faces;

(b) A firmly fixed pair of control coils 3 and 4 wound adjacent and on either side of the radially poled permanent magnet 2, wired to form a single solenoid like control coil with the same directional magnetic flux when energized;

(c) A magnetic armature 6 shorter than the distance between the end closures 1*a* and 1*b* to produce an air gap on one side when against one of the end closures 1*a* or 1*b* and free to move parallel to its length between the end closures 1*a* and 1*b;*

(d) A bearing 7 firmly attached and coaxially centered inside the armature 6 as not to degrade the function of the armature 6, preferably centered along the length and shorter than the armature 6 to minimize the flux leakage from the permanent magnet 2 to the end closures 1*a* and 1*b*, and can take on many different designs for transmitting linear, reciprocating or rotational forces; and (e) A shaft 8 firmly attached and coaxially centered through the bearing 7 and through the length of the armature 6 as not to degrade the function of the armature 6, preferably non-magnetic or designed to minimize the flux leakage between the permanent magnet 2 and the attractors 1*a* and 1*b*, extending through one or both of the attractors 1*a* and 1*b* of the magnetic housing 1, and can take on many different designs for transmitting linear, reciprocating or rotational forces.

In FIGS. 1-3, as used throughout this specification, (a) The size of the air gap between an attractor 1*a* or 1*b* and one end of the armature 6 is a function of the design requirements of the magnetic actuator 10 needed for the application used, (b) The maximum latching force attainable is a function of the permanent magnet's magnetic residual flux density (Br), magnetic flux leakage from: the magnetic housing 1 and armature 6, and the facing areas of the armature 6, the bearing 7 and shaft 8 to the end closures 1*a* and 1*b,*

(c) The magnetic housing 1 and the armature 6, regardless of the shape or size, the preferably formed of soft iron, steel or some other magnetic material, with the preferred material being one which provides low reluctance, exhibits low hysteresis, and has a high magnetic flux density capability; likewise could be of laminate type construction.

(d) A thin non-magnetic tube 5 can be placed through the radially poled permanent magnet 2 and the control coils 3 and 4 about the armature 6 extending between the end closures 1*a* and 1*b* of the magnetic housing 1 to allow the armature 6 to move more freely.

(e) The method to firmly fix the permanent magnet 2, control coils 3 and 4, and the tube 5 inside the magnetic housing 1 can be through any means that does not take away from the functionality of the present invention.

(f) The leakage magnetic flux from the various components is disregarded for simplicity in this specification, but may need to be understood for proper magnetic force in various designs using the present invention.

(g) The armature 6 may require a mechanism to keep it from rotating.

As illustrated in FIG. 2, under no power to the control coils 3 and 4, the armature 6 is magnetically latched to the attractor 1*a* with the least air gap, whereby the magnetic flux (arrows) follows a radial path through the permanent magnet 2, bi-directionally through the armature 6 with the majority of the magnetic flux (solid arrows) in one direction through the attractor 1*a* and with the residual magnetic flux (dash arrow) being in the other direction through attractor 1*b*. In each direction, the magnetic flux (arrows) follows a path through the housing 1 back to the permanent magnet 2.

In reference to FIGS. 2-3, upon application of the power to the control coils 3 and 4 to reverse the direction of the primary magnetic flux from the permanent magnet 2 toward the end closure 1*b*, the armature 6 become more attracted to the end closure 1*b* moving toward end closure 1*b* to close the air gap. Provided the bearing 7 is firmly attached the armature 6 and the shaft 8 is firmly attached the bearing 7, they will move and stop together, accordingly.

As illustrated in FIG. 3, under no power to the control coils 3 and 4, the armature 6 is magnetically latched to the end closure 1*b* now having the least air gap, whereby the magnetic flux (arrows) follows a radial path through the permanent magnet 2, bi-directionally through the armature 6 with the majority of the magnetic flux (solid arrows) in one direction through the attractor 1*b* and with the residual magnetic flux (dash arrow) being in the other direction through end closure 1*a*. In each direction, the magnetic flux (arrows) follows a path through the housing 1 back to the permanent magnet 2.

Control of the Coils

Figure 4:
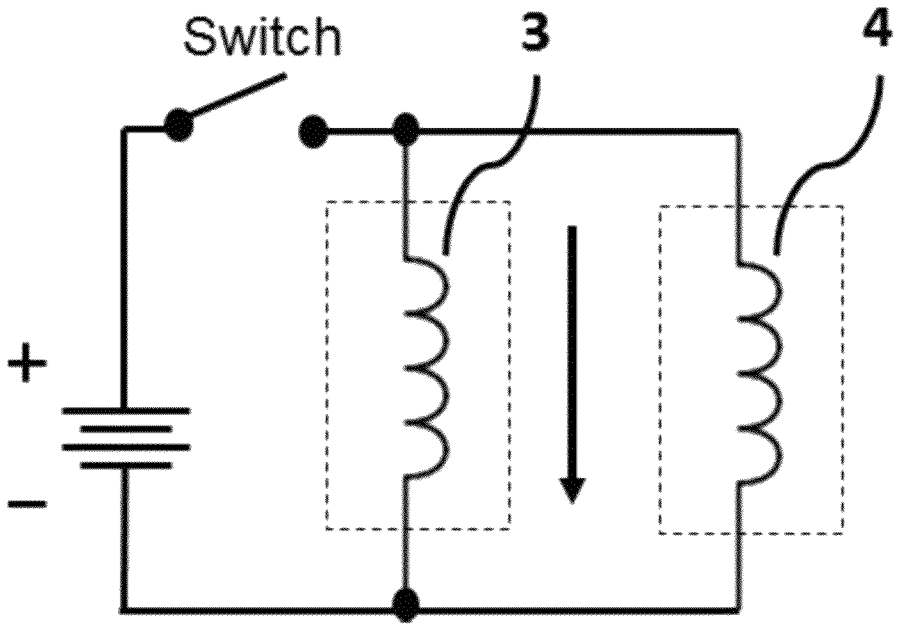
FIGS. 4-5 show the parallel connection of the control coils in a divergent flux path magnetic actuator to reduce the voltage from the power source.
Figure 5:
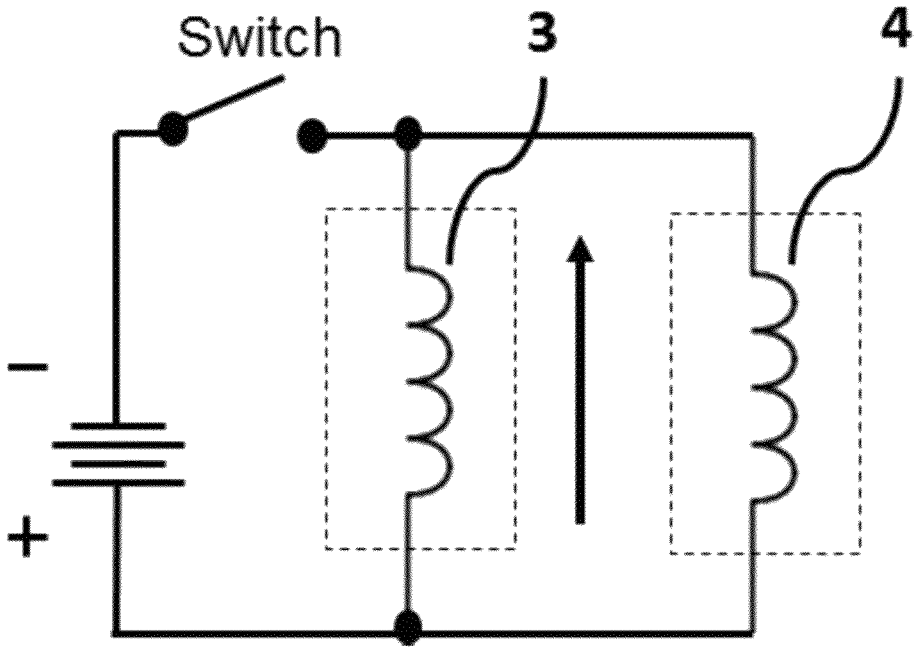

FIG. 4-5 shows the preferred parallel connection of the control coils 3 and 4, as used throughout this specification, to an alternating voltage/current source, where the arrow indicates the direction of the current through the coils when the switch is closed. It is understood that series connection can also be made, but will increase the total circuit resistance, requiring a higher voltage for a given pair of coils. In FIG. 4-5, the number of turns and the resistances of the control coils 3 and 4 are the same. The switching of the control coils voltage to reverse the current direction can be done with mechanical switches, relays or using various ICs or other methods as desired.

Figure 6:
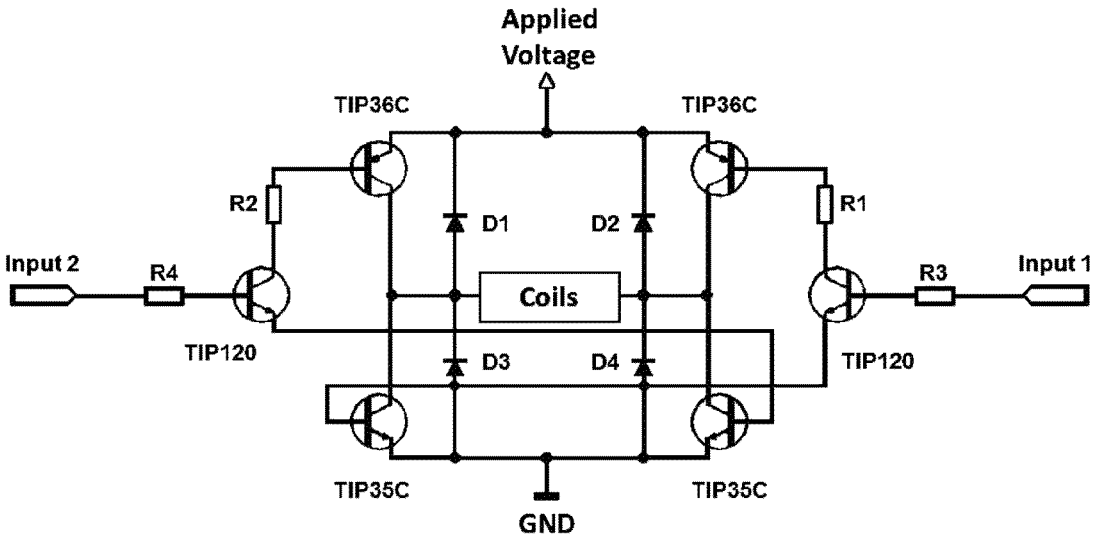
FIG. 6 shows one of many H-bridge designs that are uniquely capable of pulsing a directional and alternating energizing current to the control coils in the present invention.

FIG. 6 shows one of many H-bridge designs, which is the preferred circuit to alternately energize the control coils pair 3 and 4 in a pulsed timed sequential manner to produce linear or bi-linear magnetic force between the armature 6 and the end closures 1*a* and 1*b* to form a magnetic actuator for various applications. Connection of the control coils pairs 3 and 4 (represented by the word "Coils") as shown in FIG. 6 allows single directionality of the magnetic flux in the armature 6 by applying a pulsed voltage to either "Input 1" or "Input 2" per standard H-bridge designs, which will pulse energize the control coil pairs 3 and 4 in like current direction.

In FIG. 6 is shown one type of H-bridge using TIP 36C/35C ICs with an Applied Voltage and ground (GND). The diodes D1-D4 are for back emf protection. For the TIP 36C/35C ICs, the resistors R1 and R2 are approximately 270 ohms. The TIP-120 ICs are used as they can be controlled with a pulsed 5V TTL signal from a computer for ease in operation. The resisters R3 and R4 may not be needed for a pulsed TTL signal from a computer, but may for direct connection to a voltage source. The inputs (1 and 2), Resisters (R3 and R4) and the TIP-120 ICs can be replaced with other types of switching methods provided they are pulsed in the proper manner as not to degrade the operation of the present invention.

In reference to FIGS. 2-3 and FIG. 6, when the proper voltage/current is applied to the proper input, either "Input 1" or "Input 2", the permanent magnet-magnetic flux (solid arrows) is diverted through the armature 6 as defined by the direction of the magnetic flux (solid arrows) produced by the control coil pairs 3 and 4; reversing the voltage/current directions in sequence produces the opposite effect. For a given force, wire size, and number of coil turns, the pulsing time required to unlatch and attract the armature 6 to an end closure 1*a* or 1*b* has been shown to decrease with increasing applied voltage. It has also been shown that increasing the voltage also allows for increased air gap distances. This allows for the development of divergent flux path electromagnets and magnetic actuators having variable reaction times and air gap distances with applied voltage.

Figure 7:
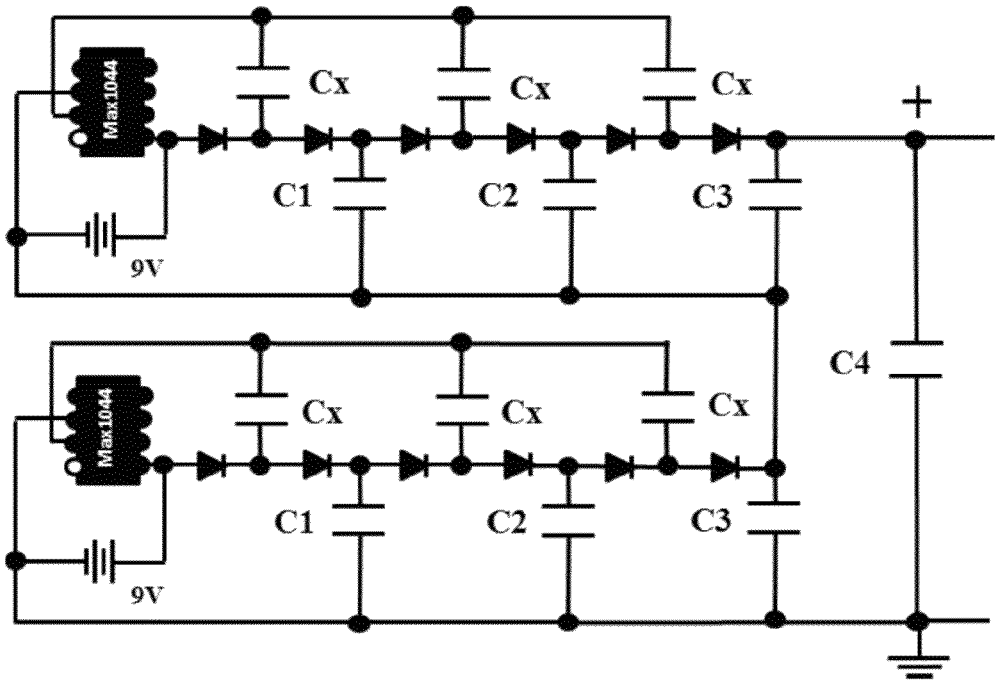
FIG. 7 shows one method of charging a capacitor to voltages greater than 9V, providing the power source for the pulse current discharged through the H-bridge of FIG. 6.

FIG. 7 shows one of many low power capacitor charging circuits that can provide an impulse current through the H-bridge of FIG. 6 in order to reduce the energy input to the control coils pairs 3 and 4 providing for a highly energy efficient magnetic actuator. Per the MAX1044 data sheet, each voltage multiplier circuit produces 17V on capacitor "C1", 25V on capacitor "C2" and 33V on capacitor "C3". The series connection as shown between the two MAX1044 voltage multiplier circuits with independent 9V sources produced approximately 60V on capacitor "C4" during testing. Increased charging voltage can be achieved by series addition of more MAX1044 voltage multiplier circuits. Although adequate, the MAX1044 voltage multiplier circuit may be slow for some applications. For faster pulse rates, direct connection of the H-bridge to the power source or another type of faster charging voltage multiplier circuits should be used.

Energy Efficient

Figure 8:
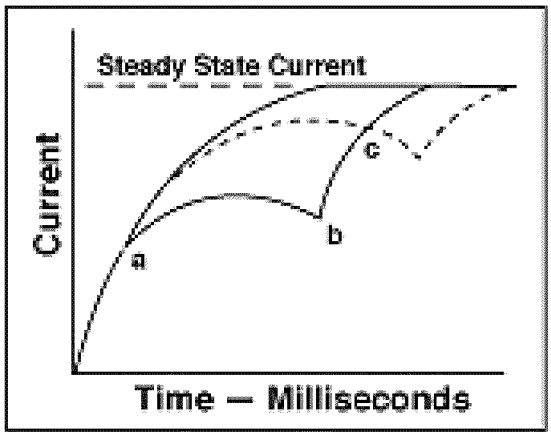
FIGS. 8-10 are current traces.

FIG. 8 illustrates the current trace for conventional magnetic actuators. When a DC voltage is impressed across the control coil, the current will rise to point (a), where the armature motion occurs as represented by the downward current to point (b), then the current moves along trace (c) to a "Steady State Current." For a given conventional magnetic actuator, the rise time to point (a) is dependent upon the load, duty cycle, input power, stroke, and temperature range. This time delay, which occurs prior to the armature motion, is a function of the inductance and resistance of the coil, and the magnetic flux required to move the armature 6 of the present invention.

Figure 9:
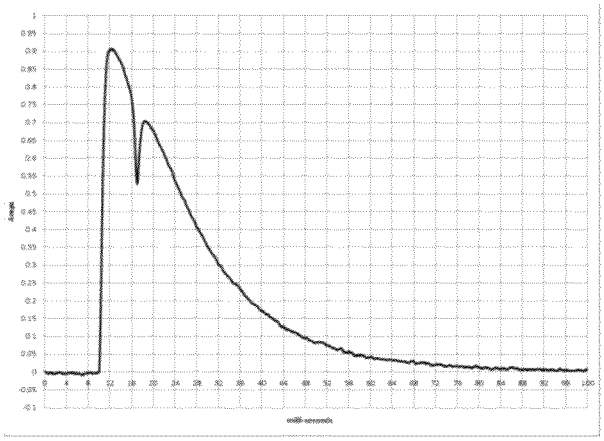
Figure 10:
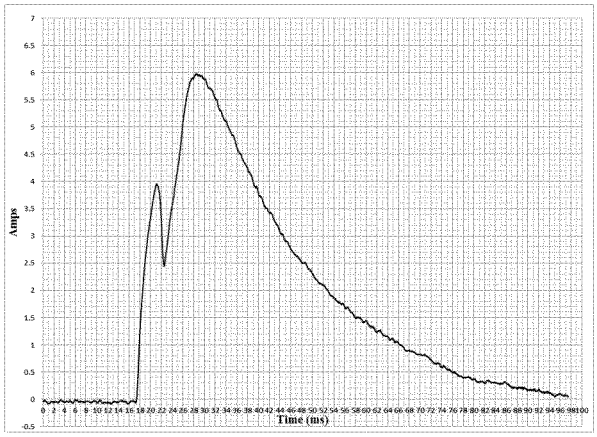

FIGS. 9-10 are current traces from two different versions of the present invention using the same capacitor/voltage setup and the method of FIGS. 6-7, where FIG. 9 shows an ideal current trace for minimum energy usage and FIG. 10 shows that the capacitor/voltage setup was over designed for the version of the present invention used. In comparison to FIG. 8, the current traces, FIGS. 9-10, do not show a "Steady State Current" as once magnetically latched and the capacitor is discharged no more power is required. The absent of the "Steady State Current" represents a power savings over prior art. Dissipation of the energy from a capacitor then provides for a highly energy efficient replacement over the prior art of conventional electromagnets and magnetic actuators having a steady state current. The use of the over designed capacitor as shown in FIG. 10 may be required for systems with varying load, duty cycle, motion distance, input power, or temperature range.

It is noted that the capacitor used to control the present invention, decreases the time delay, which occurs prior to the armature motion. The time delay can be decreased further by increasing the voltage.

Additional Force Mechanism

A divergent flux path magnetic actuator can be enhanced for greater linear motion distance, output force or increased electrical efficiency through the adaptation of other force mechanisms that do not require electrical power. An additional force mechanism is demonstrated in FIGS. 11-12, where springs 9L and 9R are used to aid in the motion of the actuator 6.

Figure 11:
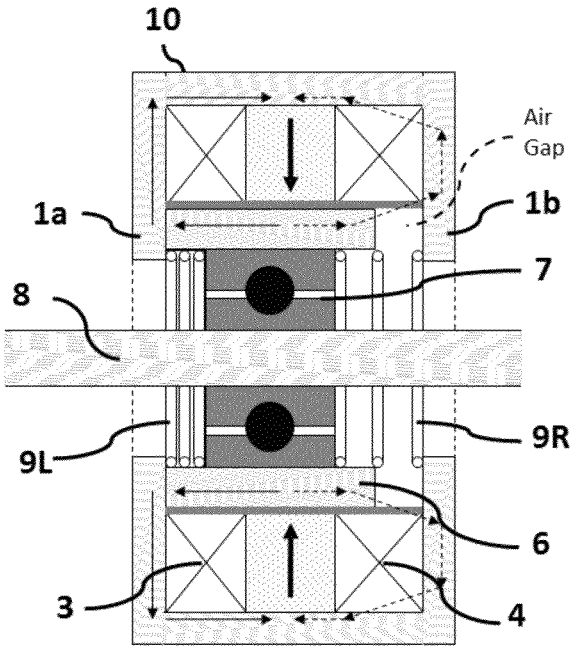
FIGS. 11-12 are cross-sectional views of FIGS. 2-3 showing the addition of springs as additional force mechanisms.
Figure 12:
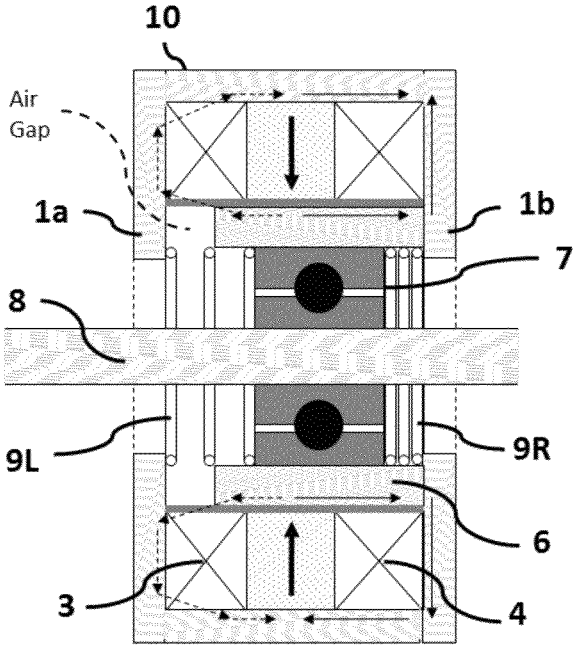

In FIG. 11, the spring 9L is compressed between end closure 1*a* and the bearing 7, while spring 9R is relaxed. In FIG. 12, the spring 9R is compressed between end closure 1*b* and the bearing 7, while spring 9R is relaxed. The initial spring compression 9L or 9R is done during assembly of the actuator 10. The compression force in spring 9L or 9R allows for lower electrical power activation of the actuator 10 during the reversal of the magnetic holding force between end closure 1*a* or 1*b* and the armature 6, toward the armature 6 and enclosure 1*b* or 1*a*, as the residual magnetic holding force can be higher—compensated by the spring force to increased electrical efficiency. It is easily seen that the extra spring force can add to the output force and the additional spring length can add to the linear motion distance of the armature 6 with bearing 7 and shaft 8.

Spline Shaft

Figure 13:
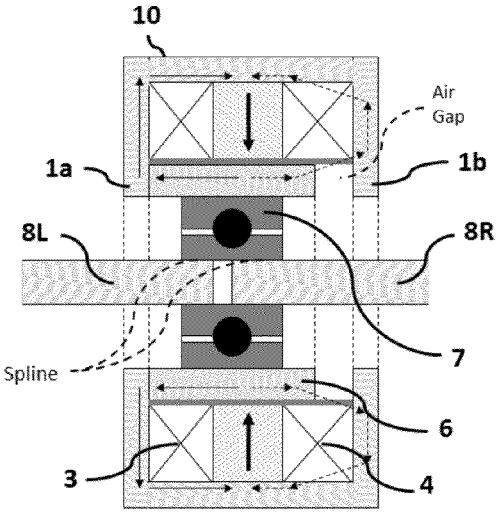
FIGS. 13-14 are cross-sectional views of FIGS. 2-3 showing how a divergent flux path magnetic actuator can be modified for use in a spline shaft to disengage two rotating shafts.
Figure 14:
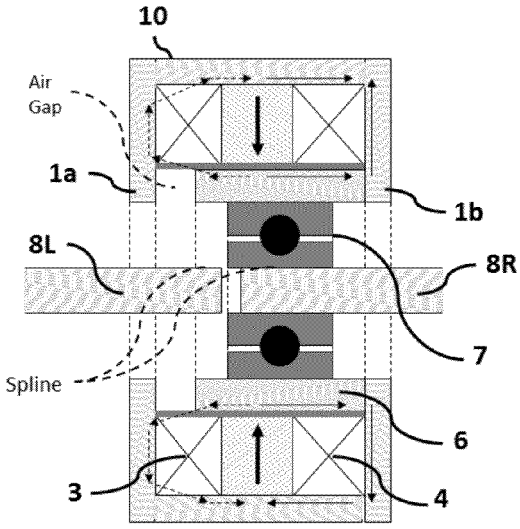

FIGS. 13-14 are cross-sectional views of the magnetic actuators 10 of FIGS. 2-3 showing one modification method for use to unite or disengage two rotating spline shafts 8L and 8R. As with FIGS. 2-3, under no power to the control coils 3 and 4 the armature 6 will remain magnetically latched to the end closures 1*a* or 1*b* with the least air gap, for example, end closure 1*a* in FIG. 13 and end closure 1*b* in FIG. 14. The center bore of the bearing 7 is splined, in like to FIG. 15, and matched with FIG. 16. In FIG. 13, two spline matched shafts 8L and 8R, in like to FIG. 16, are placed in the bearing 7. The two spline matched shafts 8L and 8R are attached to other devices (not shown) in a way that does not let them move with respect to the movement of the bearing 7.

Figure 15:
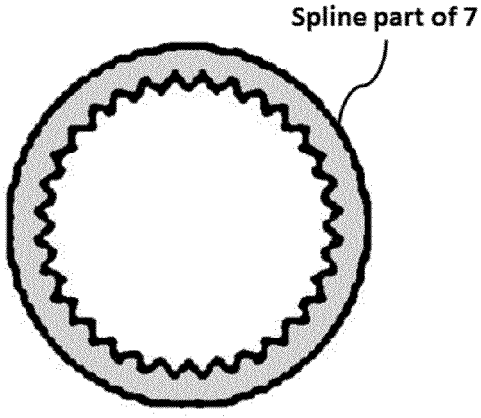
FIGS. 15-16 show a representative spline shaft mating pattern for use in FIGS. 13-14.
Figure 16:
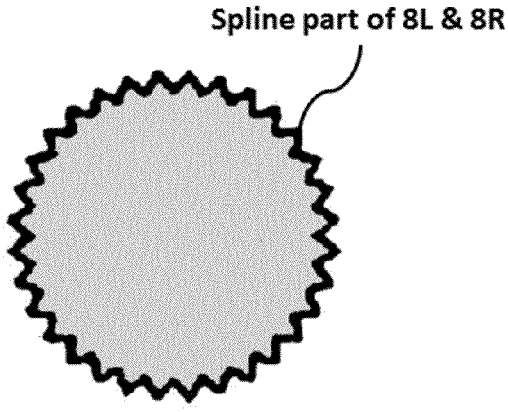

FIGS. 15-16 are reference bearing spline (FIG. 15) bore teeth pattern and shaft (FIG. 16) outer teeth patterns, where the shape and number of teeth are design dependent. It is understood that:

a. The teeth pattern in FIG. 15 is though the center bore of the bearing 7 and the teeth pattern length in FIG. 18 on the shafts 8L and 8R only needed to be long enough to inner the center bore of the bearing 7 to the appropriate functional length, and b. The magnetic actuators 10 is firmly attracted to both of the devices containing the shafts 8L and 8R, and that one device provides the proper function for producing rotational force and the other device provides the proper function for transferring the rotational force.

What is claimed is:

1. A Divergent Flux Path Magnetic Actuator with reciprocating and rotatable shaft comprising:

An outer magnetic housing with pole end closures containing a radially poled ring or toroidal shaped permanent magnet, two control coils with one on either side of the said permanent magnet, and a magnetic armature movable between said pole end closures;

the said magnetic armature contains a firmly fixed bearing to allow firm placement and rotation of a shaft through the center of said bearing;

the said pole end closures have holes to allow extension of the said shaft outward in both directions, and free linear and rotational movement;

the said two control coils act as a single control coil to produce same direction magnetic field when a current is applied, to attract the said armature to the said pole end closures in an alternating fashion with the direction dependent on the direction of the current through said control coil;

wherein the alternate switching of the current to the said coil control coils allow linear reciprocating movement of the said rotatable shaft for a variety of applications.

2. The device of claim 1, wherein the shaft is two pieces with the two shaft pieces forming mating feature or spline with the said bearing to allow one said shaft piece to detach from said bearing in one direction and attachment of the one said shaft piece in said bearing in the other direction with the other said shaft piece remaining attached to the bearing while moving in both direction.

3. The device of claim 1, wherein an additional force mechanism is added to aid in the amount of travel or force produced by the said armature of the device to reduce the electrical power needed to detach and move the said armature from a said pole end closure.

4. The device of claim 1, wherein a fixed tube composed of a thin nonmagnetic material is placed about the said armature with length between the said pole ends closures of the said outer magnetic housing to allow free movement of the said armature.

5. A method for producing alternating current to the device in claim 1 with low power input and low energy drain comprising a fixed current electrical power source, a H-bridge, and a capacitor, wherein:

the said fixed current electrical power source is connected to the said capacitor and charges said capacitor to a voltage with a current lower than the proper current value need to activate the said control coils of said device, the H-bridge is time sequence pulsed, and connected to the said capacitor and said control coils of said device to provide a time sequence current at said voltage from the said capacitor to the said control coils of said device;

the capacitor is chosen to contain the said voltage with capacitance required by the resistance plus reluctance of said device to give the proper pulsed current value and pulse time needed to activate the said device with the peak power to said control coils of said device being higher than that capable of by the fixed current electrical power source, to allow for low power input;

the voltage of the said fixed current electrical power source is that required by the said capacitor to give the proper peak current value needed to activate the said device;

wherein the said fixed current electrical power source is allowed to charge the said capacitor to the said voltage, at which time pulsed activation of one leg of the H-bridge will deliver a pulsed current to the said control coils of said device in one direction, and pulsed activation of the other leg of the H-bridge will deliver a pulsed current to the said control coils of said device in the other direction, with the said time pulse activation only long enough to allow complete movement of the said armature of said device to reduce the energy drain from the said fixed current power source.

* * * * *